US008882067B2

(12) United States Patent
Kerr

(10) Patent No.: US 8,882,067 B2
(45) Date of Patent: Nov. 11, 2014

(54) GUIDE TRACK SYSTEM AND COMPONENTS THEREOF

(75) Inventor: James F. Kerr, Croswell, MI (US)

(73) Assignee: Material Control, Inc., Croswell, MI (US)

( * ) Notice: Subject to any disclaimer, the term of this patent is extended or adjusted under 35 U.S.C. 154(b) by 122 days.

(21) Appl. No.: 13/101,575

(22) Filed: May 5, 2011

(65) Prior Publication Data

US 2011/0283482 A1 Nov. 24, 2011

Related U.S. Application Data

(60) Provisional application No. 61/347,414, filed on May 22, 2010, provisional application No. 61/347,416, filed on May 22, 2010.

(51) Int. Cl.
*A47F 5/00* (2006.01)
*E06C 1/397* (2006.01)
*E06C 1/34* (2006.01)

(52) U.S. Cl.
CPC .. *E06C 1/397* (2013.01); *E06C 1/34* (2013.01)
USPC ..... 248/298.1; 248/224.7; 248/200.1; 248/210; 182/36; 182/39; 182/74

(58) Field of Classification Search
USPC ..... 248/298.1, 240, 240.3, 295.11, 285.1, 248/200, 76, 77, 200.1, 236, 210, 214, 248/219.1, 219.3, 220.21, 224.7, 225.11; 182/38, 39, 15, 97, 86, 84, 127, 206, 182/107, 214, 36
See application file for complete search history.

(56) References Cited

U.S. PATENT DOCUMENTS

| | | | | | |
|---|---|---|---|---|---|
| 888,383 | A | * | 5/1908 | Asch | 182/39 |
| 1,887,301 | A | * | 11/1932 | Gordon | 182/36 |
| 2,881,040 | A | | 4/1959 | Hartridge | |
| 3,029,897 | A | | 4/1962 | Moberg | |
| 3,239,070 | A | * | 3/1966 | Clauson | 211/105.1 |
| 3,306,585 | A | * | 2/1967 | Blum | 256/69 |
| 3,336,004 | A | | 8/1967 | Edie et al. | |
| 3,433,460 | A | * | 3/1969 | Kusel et al. | 256/65.16 |
| 3,434,566 | A | * | 3/1969 | Miller | 182/15 |
| 3,544,072 | A | * | 12/1970 | Thom | 256/59 |
| 3,729,062 | A | | 4/1973 | Freiburger | |
| 4,006,874 | A | * | 2/1977 | McGee | 248/74.3 |
| 4,388,982 | A | * | 6/1983 | Yonahara | 182/82 |
| 4,541,507 | A | * | 9/1985 | Gibellato | 182/86 |
| 4,846,303 | A | * | 7/1989 | Cooper et al. | 182/36 |
| 4,895,332 | A | * | 1/1990 | Hansen et al. | 248/251 |

(Continued)

*Primary Examiner* — Terrell McKinnon
*Assistant Examiner* — Monica Millner
(74) *Attorney, Agent, or Firm* — Dykema Gossett PLLC

(57) ABSTRACT

A guide track system and a bracket assembly thereof for supporting guide tracks thereof are provided. The guide track system comprises a first guide track piece, a second guide track piece, and a bracket assembly configured to support the first and second guide track pieces. The bracket assembly comprises a mounting feature configured to be mounted to a support structure, and a guide track supporting feature connected to the mounting feature and configured to support a portion of the guide track mounted thereon. The guide track supporting feature, in turn, comprises a body having a first end, a second end, and a longitudinal axis extending through the first and second ends, wherein the first end is configured to be coupled with an end of the first guide track piece, and the second end is configured to be coupled with an end of the second guide track piece.

19 Claims, 4 Drawing Sheets

(56) References Cited

U.S. PATENT DOCUMENTS

| | | | | | |
|---|---|---|---|---|---|
| 4,971,268 | A | * | 11/1990 | Dobrowski et al. | 244/135 R |
| 5,279,385 | A | * | 1/1994 | Riches et al. | 182/3 |
| 5,343,975 | A | * | 9/1994 | Riches et al. | 182/3 |
| 5,366,052 | A | * | 11/1994 | Keh-Lin | 182/88 |
| 5,370,368 | A | | 12/1994 | Terrels et al. | |
| 5,480,002 | A | | 1/1996 | Kerr | |
| 5,529,288 | A | | 6/1996 | Cheng-I | |
| 5,653,307 | A | | 8/1997 | Kerr | |
| 5,769,460 | A | | 6/1998 | Imai | |
| 5,979,599 | A | | 11/1999 | Noles | |
| 5,993,100 | A | | 11/1999 | Gastmann | |
| 6,073,725 | A | * | 6/2000 | Kumher et al. | 182/39 |
| 6,105,720 | A | * | 8/2000 | Kumher et al. | 182/127 |
| 6,138,574 | A | | 10/2000 | Zaguroli, Jr. | |
| 6,230,841 | B1 | | 5/2001 | Valore | |
| 6,269,907 | B1 | * | 8/2001 | Gillespie | 182/129 |
| 6,315,078 | B1 | * | 11/2001 | Kumher et al. | 182/127 |
| 6,505,708 | B2 | * | 1/2003 | LaBrash | 182/127 |
| 6,619,427 | B1 | * | 9/2003 | Kerr | 182/39 |
| D581,772 | S | | 12/2008 | Hozen | |
| 7,503,276 | B1 | * | 3/2009 | Curi et al. | 114/362 |
| 7,600,349 | B2 | * | 10/2009 | Liebendorfer | 52/173.3 |
| 7,677,595 | B2 | * | 3/2010 | Dominissini et al. | 280/728.2 |
| 7,699,278 | B2 | | 4/2010 | Goldstein | |
| 7,757,813 | B2 | * | 7/2010 | Kerr | 182/39 |
| 7,815,389 | B2 | * | 10/2010 | Wagner et al. | 403/306 |
| 8,322,490 | B1 | * | 12/2012 | Loemker | 182/127 |
| 8,356,802 | B2 | * | 1/2013 | Reich | 256/65.16 |
| 2003/0024893 | A1 | * | 2/2003 | Ellbogen et al. | 211/123 |
| 2010/0252792 | A1 | * | 10/2010 | Bennett | 256/21 |

* cited by examiner

GUIDE TRACK SYSTEM AND COMPONENTS THEREOF

CROSS REFERENCE TO RELATED APPLICATIONS

This application claims the benefit of U.S. Provisional Application Ser. No. 61/347,414 entitled "ERW Tube Track Support System," which was filed on May 22, 2010, and U.S. Provisional Application Ser. No. 61/347,416 entitled "Open Seam Tube Track Support System," which was filed on May 22, 2010, both of which are hereby incorporated by reference in their entireties.

FIELD OF THE INVENTION

This disclosure relates to a guide track system and components thereof. More particularly, this disclosure relates to a guide track system and components thereof used, for example, in connection with track-mounted ladder systems.

BACKGROUND OF THE INVENTION

It is well known to mount a ladder to one or more guide track systems to thereby allow for the movement of the ladder in one or more directions. Common examples of where such track-mounted ladders may find application include libraries, stock rooms, warehouses, and the like where there are one or more relatively long and high storage racks or shelving units. Often times these types of ladder systems require relatively long runs of guide track upon which the ladder is mounted and along which it is configured to travel, to allow for access to different areas of the storage racks or shelving units.

The guide track system, or in an example wherein the are two guide tracks (i.e., dual-track system), the guide track systems, may comprise, for example, a guide track formed of a plurality of guide track pieces such as, for example, electric resistance weld (ERW) tubing, or open seam tubing. The guide track, and the constituent pieces thereof, in particular, are typically mounted or affixed to the storage racks or shelving units. This can be accomplished in a number of ways. For example, one common mounting technique is to provide a mounting bracket configured to mount a piece of the guide track to a support structure, such as, for example, a vertical member or upright of the storage rack or shelving unit, and to also provide a plurality of dowels separate and distinct from the mounting bracket, to join adjacent guide track pieces together.

Conventional techniques, such as that described above, are not without their drawbacks, however. For example, because the dowels and the mounting brackets are separate and distinct from each other, every piece of track must be supported by an individual mounting bracket, which results in the increase in both the number of components, the installation time, and the cost of the installation and the ladder system itself. Similarly, for purposes of robustness and safety, the dowels cannot be placed within a given distance (e.g., six inches) from the mounting brackets, which results in the layout and installation being more expensive, time consuming, and complex due to, for example, required in-field cutting of the track pieces. Further, in dual-track systems, the dowel placements along the respective guide tracks have to be staggered in order to sufficiently meet the load capacity of the ladder system, which also results in the layout and installation being more expensive, time consuming, and complex due to, for example, required in-field cutting of the track pieces.

Therefore, there is a need for a bracket assembly for supporting guide tracks that will minimize and/or eliminate one or more of the above-identified deficiencies.

SUMMARY OF THE INVENTION

One aspect of the present invention is directed to a bracket assembly for supporting guide tracks. The bracket assembly, in accordance with present teachings, comprises a mounting featuring configured to be mounted to a support structure. The bracket assembly further comprises a guide track supporting feature connected to said mounting feature and configured to support a portion of the guide track mounted thereon. The guide track supporting feature comprises a body having a first end, a second end, and a longitudinal axis extending through the first and second ends, wherein the first end is configured to be coupled with an end of a first piece of the guide track, and the second end is configured to be coupled with an end of a second piece of the guide track.

In an exemplary embodiment, the mounting feature has a vertical portion configured to be mounted to the support structure, and a horizontal portion having a proximal end and a distal end. In an exemplary embodiment, the horizontal portion is connected at the proximal end thereof to the vertical portion of the mounting feature.

In accordance with another aspect of the invention, a guide track system is provided. In accordance with the present teachings, the system comprises a first guide track piece, a second guide track piece, and a bracket assembly configured to support the first and second guide track pieces. The bracket assembly comprises a mounting feature configured to be mounted to a support structure, and a guide track supporting feature connected to the mounting feature and configured to support a portion of the guide track mounted thereon. The guide track supporting feature, in turn, comprises a body having a first end, a second end, and a longitudinal axis extending through the first and second ends, wherein the first end is configured to be coupled with an end of the first guide track piece, and the second end is configured to be coupled with an end of the second guide track piece.

Further features and advantages of the present invention, including the constituent components thereof, will become more apparent to those skilled in the art after a review of the invention as it is shown in the accompanying drawings and detailed description.

DETAILED DESCRIPTION OF PREFERRED EMBODIMENTS

Figure 1:
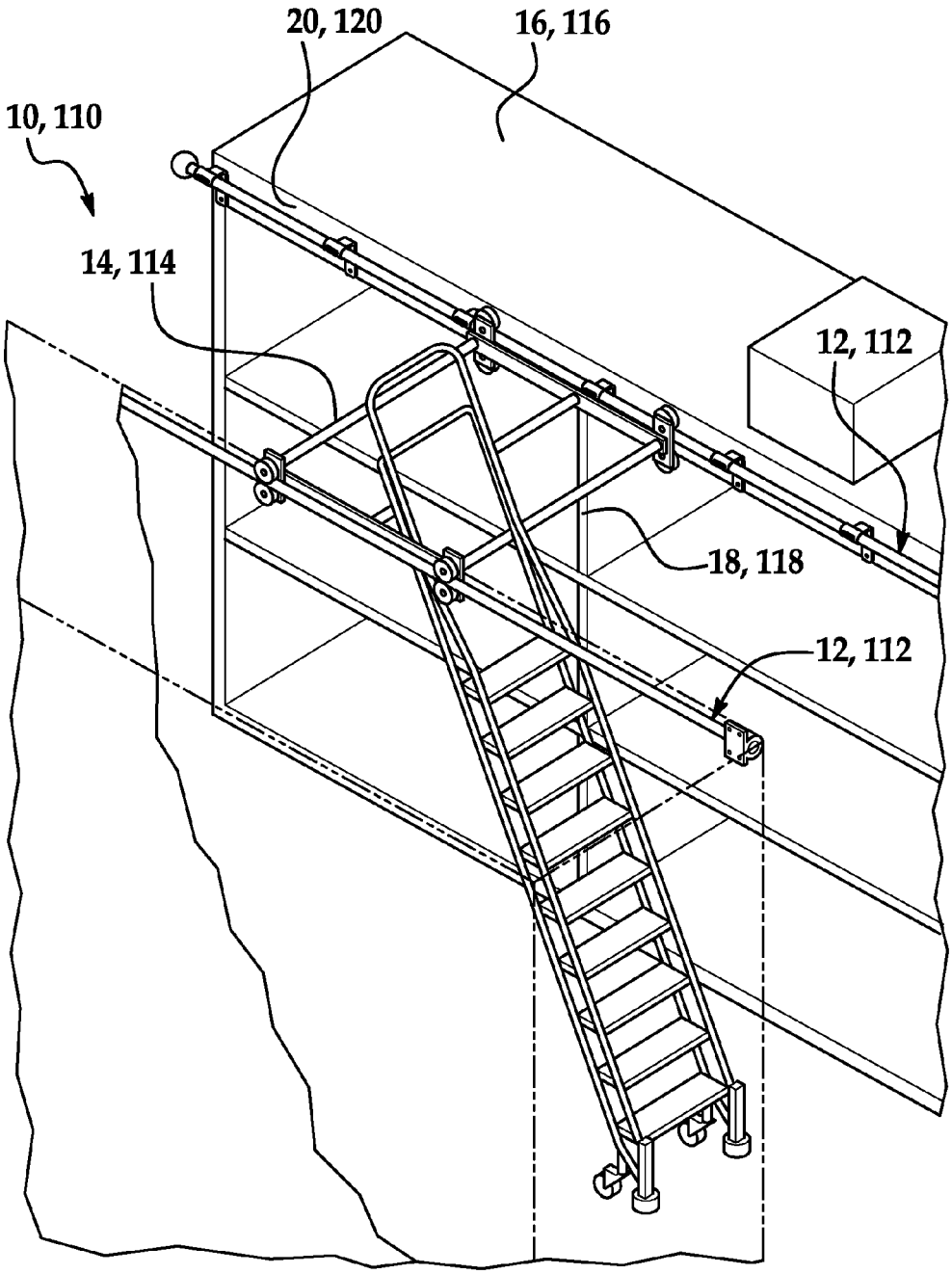
FIG. 1 is an isometric and diagrammatic view of an exemplary embodiment of a track-mounted ladder system in accordance with the present teachings.

Referring now to the drawings wherein like reference numerals are used to identify identical components in the various views, FIG. 1 illustrates an exemplary embodiment of a track-mounted ladder system 10. The ladder system 10 illustrated in FIG. 1 is a dual-track ladder system wherein a first guide track system 12 is disposed on one side of an aisle, a second guide track system 12 is disposed on the opposite side of the aisle, and a ladder assembly 14 (e.g., a ladder and a wheeled trolley or carriage to which the ladder is associated) is mounted to both guide track systems 12. It will be appreciated, however, that the present disclosure is not meant to be limited to such an embodiment. Rather, single-track ladder systems and ladder systems having multiple guide track systems 12 disposed on the same side of an aisle or mounted to the same structure remain within the spirit and scope of the present disclosure. For purposes of clarity and illustration only, the description below will be limited to an embodiment wherein the ladder system 10 comprises a single guide track system 12.

The guide track system 12 is configured to be mounted to a support structure 16, such as, for example, and without limitation, a wall, a storage rack, or a shelving unit illustrated, for example, in FIG. 1. More particularly, the guide track system 12 may be mounted to uprights or vertical members 18 of the support structure 16, or to a suitable horizontally disposed surface, such as, for example, the surface 20 of the support structure 16 illustrated in FIG. 1.

Figure 2:
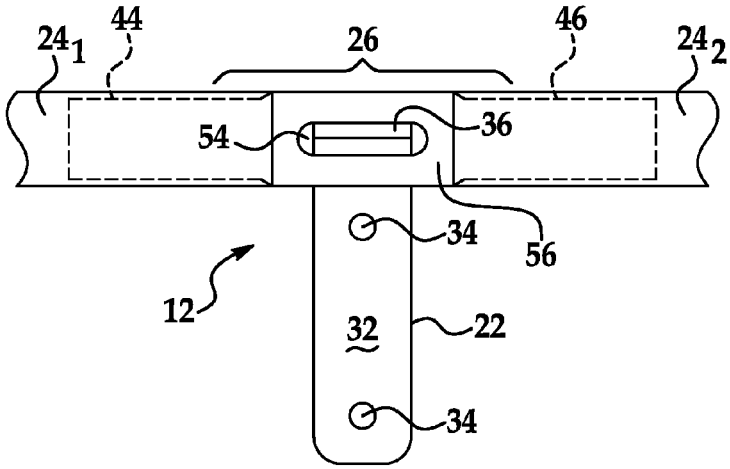
FIG. 2 is a partial front view of an exemplary embodiment of a guide track system for use in the track-mounted ladder system illustrated in FIG. 1.

With reference to FIG. 2, in an exemplary embodiment the guide track system 12 comprises, in part, a bracket assembly 22, and a pair of guide track pieces 24 that together form a portion of a guide track 26. The guide track system 12 may comprise any number of bracket assemblies 22 and a plurality of guide track pieces 24 that when assembled together, form a guide track 26 having a desired length. For example, in one embodiment, the guide track system may have one bracket assembly 22 disposed at one end of the support structure 16 and coupled with an end of a guide track piece 24, another bracket assembly 22 disposed at the opposite end of the support structure 16 and coupled with an end of another guide track piece 24, and a plurality of bracket assemblies 22 and corresponding guide track pieces 24 disposed between the two end bracket assemblies 22.

In an exemplary embodiment, the guide track pieces 24 comprise hollow pieces formed of a metallic material, such as, for example and without limitation, electric resistance weld (ERW) tubing or open seam tubing formed of steel or stainless steel, both of which are well known in the art. However, in other exemplary embodiments that remain within the spirit and scope of the present disclosure, the guide track pieces 24 may be formed of other types of metal or materials other than metal, such as, for example, certain polymeric materials known in the art. Further, the guide track pieces 24 may have any number of cross-sectional shapes, such as, for example and without limitation, circular, oval, and polygonal. Accordingly, present disclosure is not limited to any particular type or cross-sectional shape of guide track pieces. As will be described in great detail below, the bracket assemblies 22 are each configured to mount one or more of the guide track pieces 24 to the support structure 16, and may also be configured to join adjacent guide track pieces 24 together.

Figure 3:
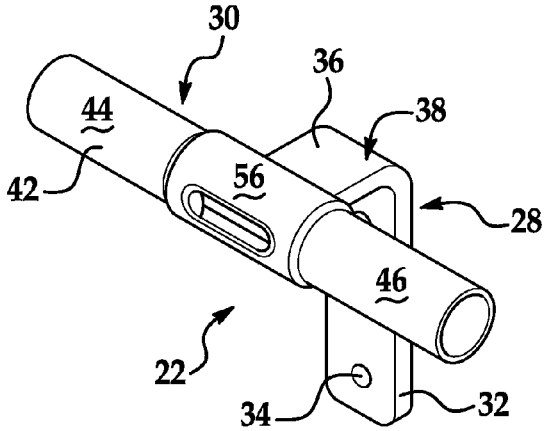
FIG. 3 is an isometric view of an exemplary embodiment of a bracket assembly of the guide track system illustrated in FIG. 2.
Figure 4:
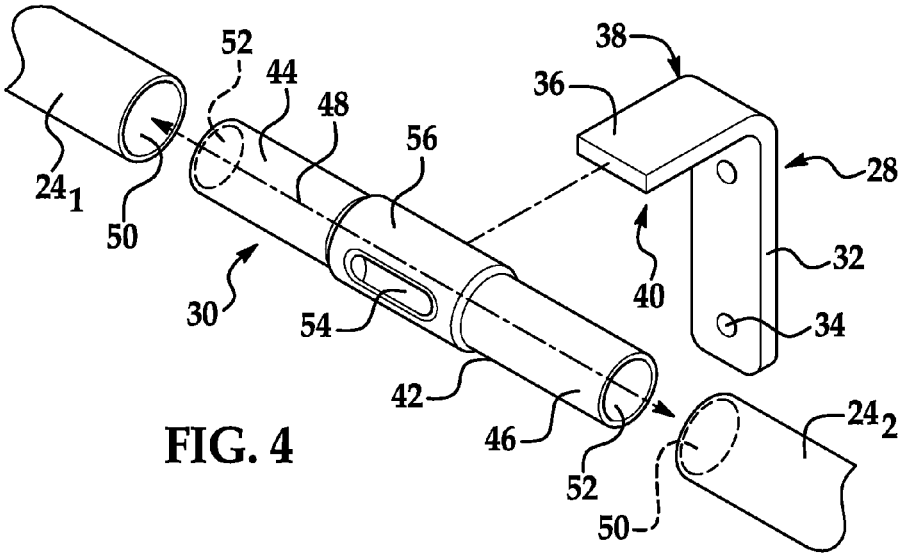
FIG. 4 is an exploded isometric view of the guide track system partially illustrated in FIG. 2.

With reference to FIGS. 3 and 4, in an exemplary embodiment the bracket assembly 22 comprises a mounting feature 28 configured to be mounted to the support structure 16, and a guide track supporting feature 30 connected to the mounting feature 28 and configured to support one or more pieces 24 of the guide track 26 of the guide track system 12.

In an exemplary embodiment, the mounting feature 28 comprises a flange or mounting plate configured to allow for the bracket assembly 22 to be mounted to the support structure 16. For example, and as illustrated in FIGS. 3 and 4, the mounting feature 28 may comprise a vertical portion 32 configured to be mounted to the support structure 16. However, in another exemplary embodiment, rather than the mounting feature 28 comprising a vertical portion, it may comprise a horizontal portion configured to be mounted to the support structure 16. For purposes of clarity and illustration only, the description below will be limited to an embodiment wherein the mounting feature 28 comprises a vertical portion 32. It will be appreciated, however, that the present disclosure is not meant to be so limited.

In an exemplary embodiment, the vertical portion 32 comprises one or more apertures 34 therein configured to receive mechanical fasteners so as to allow the mounting feature 28 to be affixed or mounted to the support structure 16. More particularly, to mount the mounting feature 28, the aperture(s) 34 is/are aligned with corresponding aperture(s) in the support structure 16 (e.g., the upright or vertical member 18 or horizontal surface 20), and then a mechanical fastener (not shown), such as, for example and without limitation, a screw, bolt, pin, or the like, is inserted therethrough. In another exemplary embodiment, rather than the vertical portion 32 of the mounting feature 28 comprising apertures 34, the vertical portion 32 includes one or more hooks disposed thereon that are configured to be inserted into complementary slots in the support structure 16. Accordingly, any number of mounting techniques well known in the art may be used to affix or mount the mounting feature 28 to the support structure 16, all of which remain within the spirit and scope of the present disclosure.

In addition to the vertical portion 32, in an exemplary embodiment, the mounting feature 28 further comprises a horizontal portion 36 having a proximal end 38 and a distal end 40 (best shown in FIG. 4). The horizontal portion 36 is connected at the proximal end 38 to the vertical portion 32, and at the distal end 40 to the guide track supporting feature 30. The horizontal portion 36 may be integral with the vertical portion 32, or may be affixed thereto using conventional techniques, such as, for example, welding, brazing, and other like techniques. Similarly, the horizontal portion 36 may be integral with the guide track supporting feature 30 or, as will be described below, may be coupled with or affixed thereto using conventional techniques. Among other things, the horizontal portion 36 is configured to provide space between the support structure 16 and the guide track 26 of the guide track system 12. It will be appreciated that in an embodiment wherein the mounting feature 28 does not include a horizontal portion, such as horizontal portion 36, the guide track supporting feature 30 would be integral with or coupled/affixed to another portion of the mounting feature 28, such as, for example and without limitation, the vertical portion 32 thereof.

As briefly described above, and with continued reference to FIGS. 2 and 3, the guide track supporting feature 30 is configured to join pieces 24 of the guide track 26 together. In such an embodiment, the bracket assembly 22 is thus configured to integrate the mounting of the guide track and the joining of guide track pieces together into a single apparatus.

With reference to FIG. 4, in an exemplary embodiment the guide track supporting feature 30 comprises a body 42 having a first end 44, a second end 46, and a longitudinal axis 48 extending through the first and second ends 44, 46. The first and second ends 44, 46 of the body 42 comprise dowel-like structures such that the first end 44 is configured to be coupled with an end of one guide track piece 24 (e.g., guide track piece $\mathbf{24}_1$), while the second end 40 is configured to be coupled with an end of another guide track piece 24 (e.g., guide track piece $\mathbf{24}_2$). Accordingly, the guide track supporting feature 30 is configured, among other things, to join two guide track pieces 24 together to create a portion of the guide track 26. In an exemplary embodiment, the other ends of the guide track pieces $\mathbf{24}_1$, $\mathbf{24}_2$ are coupled with other ends 44, 46 of adjacent bracket assemblies 22 such that each piece 24 is coupled with, and disposed between, two bracket assemblies 22.

The first and second ends 44, 46 of the body 42 of the guide track supporting feature 30 may have a number of cross-sectional shapes and may be configured to be coupled with the guide track pieces 24 in a number of ways. For example, in an exemplary embodiment, the first and second ends 44, 46 are configured to be inserted into openings 50 in the ends of the respective guide track pieces $\mathbf{24}_1$, $\mathbf{24}_2$. In such an embodiment, the cross-sectional shape of the ends 44, 46 would match the shape of the openings 50 in the ends of the guide track pieces $\mathbf{24}_1$, $\mathbf{24}_2$. Accordingly, if the openings 50 in the guide track pieces $\mathbf{24}_1$, $\mathbf{24}_2$ are circular in shape, the cross-sectional shape of the ends 44, 46 would be circular. Similarly, if the openings 50 in the guide track pieces $\mathbf{24}_1$, $\mathbf{24}_2$ are square in shape, the cross-sectional shape of the ends 44, 46 would likewise be square, and so on.

In another exemplary embodiment, rather than the ends 44, 46 being configured to be inserted into openings 50 in the guide track pieces $\mathbf{24}_1$, $\mathbf{24}_2$, the ends 44, 46 each have a bore 52 therein, each of which is configured to receive the end of a respective guide track piece 24. In an exemplary embodiment, the bores 56 are blind bores. However, in another exemplary embodiment, the body 42 of the guide track supporting feature 30 may have a through-bore extending through both the first and second ends 44, 46 of the body 42, and in such an embodiment, the through-bore comprises the bores 52 in the ends 44, 46. As with the embodiment described above, the cross-sectional shapes of the bores 52 would match the cross-sectional shapes of the ends of the respective guide track pieces $\mathbf{24}_1$, $\mathbf{24}_2$ that are configured to be inserted into the bores 52. Accordingly, if the ends of the guide track pieces $\mathbf{24}_1$, $\mathbf{24}_2$ have a circular cross-sectional shape, then the cross-sectional shape of the bores 52 would be circular. Similarly, if the ends of the guide track pieces $\mathbf{24}_1$, $\mathbf{24}_2$ are square in cross-sectional shape, then the cross-sectional shape of the bores 52 would likewise be square, and so on.

As briefly described above, in an embodiment wherein the mounting feature 28 is coupled with or affixed to the guide track supporting feature 30. In such an embodiment, the mounting feature 28 is coupled to the guide track supporting feature 30 at one or more points along the length of the guide track supporting feature 30, and may be coupled or affixed using techniques well known in the art, such as, for example, welding, brazing, and the like. In an exemplary embodiment wherein the mounting feature 28 comprises a horizontal portion 36, the horizontal portion 36 may be coupled with or affixed to the guide track supporting feature 30. In the exemplary embodiment illustrated in FIG. 4, the body 42 of the guide track supporting feature 30 comprises an opening 54 therein—which may take the form of one of a slot, an aperture, a blind or through-bore, and the like—that is configured to receive the distal end 40 of the horizontal portion 36. Accordingly, when assembled, the distal end 40 of the horizontal portion 36 is disposed within the opening 54 of the body 42. Once the distal end 40 is inserted into the opening 54, the horizontal portion 36 and the body 42 may be subjected to a process, such as, for example and without limitation, a welding, soldering, brazing, or some other like process, to further strengthen and make the joint therebetween more rigid and robust.

With reference to FIG. 2-4, in an exemplary embodiment, the body 42 of the guide track supporting feature 30 further comprises a center portion 56 disposed between the first and second ends 44, 46 thereof. The center portion 56 extends radially outward relative to the longitudinal axis 48 of the body 42 of the guide track supporting feature 30 to a greater extent than the first and second ends 44, 46. Accordingly, in an exemplary embodiment wherein the center portion 56 and the first and second ends 44, 46 have circular cross-sectional shapes, the diameter of the center portion 56 is greater than that of the first and second ends 44, 46. In another exemplary embodiment wherein the center portion 56 and the first and second ends 44, 46 have a polygonal cross-sectional shape, the center portion 56 would have a greater height than that of the first and second ends 44, 46. The center portion 56 is configured to serve one or more functions. For example, it may serve a locating function for the guide track pieces 24. More particularly, the center portion 56 provides a pair of shoulders, one on each side, that are configured to make contact with the ends of respective guide track pieces 24 when the guide track pieces 24 are properly coupled with the guide track supporting feature 30. Accordingly, when the guide track pieces 24 make contact with the center portion 56, they are fully and properly coupled with the guide track supporting feature 30. In addition, or in the alternative, the center portion 56 may be sized so as to be substantially flush with the outer surface of the guide track pieces 24 when the pieces 24 are coupled with the guide track supporting feature 30. In such an embodiment, and as illustrated in FIG. 2, the center portion 56 provides a continuous bearing surface between the two guide track pieces 24 that are coupled with the guide track supporting feature 30 to allow for the wheels of the ladder assembly 14 to smoothly traverse the joint between the guide track pieces 24.

The bracket assembly 22, and the constituent components thereof, in particular, may be formed using a number of techniques and constructed of any number of materials. For example, the bracket assembly 22 may be formed using a molding, casting, forging, extrusion, or other like or known techniques or processes. Further, the entire assembly 22 may be formed of a metallic material (e.g., steel or stainless steel), or a polymeric material. Alternatively, the bracket assembly 22 may be formed of a combination of metallic and polymeric materials such that certain portions of the bracket assembly 22 may be formed of metal, while other portions may be formed of a polymeric material. Accordingly, the construction of the bracket assembly 22 is not limited to any one particular type of material, but rather may be formed of different types of materials and combinations of materials, each of which remain within the spirit and scope of the present disclosure.

With reference to FIGS. 5-8, another exemplary embodiment of the guide track system 12 (guide track system 112) will be described. In an exemplary embodiment, the guide track system 112 comprises, in part, a bracket assembly 122 and a pair of guide track pieces 124 that together form a portion of a guide track 126. The guide track system 112 may comprise any number of bracket assemblies 122 and a plurality of guide track pieces 124 that when assembled together, form a guide track 126 having a desired length. For example, in one embodiment, the guide track system 112 may have one bracket assembly 122 disposed at one end of a support structure 116 and coupled with an end of a guide track piece 124, another bracket assembly 122 disposed at the opposite end of the support structure 116 and coupled with an end of another guide track piece 124, and a plurality of bracket assemblies 122 and corresponding guide track pieces 124 disposed between the two end bracket assemblies 122.

In an exemplary embodiment, the guide track pieces 124 comprise hollow pieces formed of a metallic material, such as, for example and without limitation, open seam tubing formed of steel or stainless steel, which is well known in the art. However, in other exemplary embodiments that remain within the spirit and scope of the present disclosure, the guide track pieces 124 may be formed of other types of metal or materials other than metal, such as, for example, certain polymeric materials known in the art. Further, the guide track pieces 124 may have any number of cross-sectional shapes, such as, for example and without limitation, circular, oval, and polygonal. Accordingly, the present disclosure is not limited to any particular type or cross-sectional shape of guide track pieces. As will be described in great detail below, the bracket assemblies 122 of the guide track system 112 are each configured to mount one or more of the guide track pieces 124 of the guide track 126 to the support structure 116, and may also be configured to join adjacent guide track pieces 124 together.

With continued reference to FIGS. 5-8, in an exemplary embodiment the bracket assembly 122 comprises a mounting feature 128 configured to be mounted to the support structure 116, and a guide track supporting feature 130 connected to the mounting feature 128 and configured to support one or more pieces 124 of the guide track 126 of the guide track system 112.

In an exemplary embodiment, and as with the embodiment illustrated in FIGS. 2-4, the mounting feature 128 comprises a flange or mounting plate configured to allow for the bracket assembly 122 to be mounted to the support structure 116. For example, and as illustrated in FIGS. 5-8, the mounting feature 128 may comprise a vertical portion 132 configured to be mounted to the support structure 116. However, in another exemplary embodiment, rather than the mounting feature 128 comprising a vertical portion, it may comprise a horizontal portion configured to be mounted to the support structure 116. For purposes of clarity and illustration only, the description below will be limited to an embodiment wherein the mounting feature 128 comprises a vertical portion 132. It will be appreciated, however, that the present disclosure is not meant to be so limited.

In an exemplary embodiment, the vertical portion 132 comprises one or more apertures 134 therein configured to receive mechanical fasteners so as to allow the mounting feature 128 to be affixed or mounted to the support structure 116. More particularly, to mount the mounting feature 128, the aperture(s) 134 is/are aligned with corresponding aperture(s) in the support structure 116 (e.g., an upright or vertical member 118 or horizontal surface 120 thereof), and then a mechanical fastener (not shown), such as, for example and without limitation, a screw, bolt, pin, or the like, is inserted therethrough. In another exemplary embodiment, rather than the vertical portion 132 of the mounting feature 128 comprising apertures 134, the vertical portion 132 includes one or more hooks disposed thereon that are configured to be inserted into complementary slots in the support structure 116. Accordingly, any number of mounting techniques that are well known in the art may be used to affix or mount the mounting feature 128 to the support structure 116, all of which remain within the spirit and scope of the present disclosure.

In addition to the vertical portion 132, in an exemplary embodiment, the mounting feature 128 further comprises a horizontal portion 136 having a proximal end 138 and a distal end 140. The horizontal portion 136 is connected at the proximal end 138 to the vertical portion 132, and at the distal end 140 to the guide track supporting feature 130. The horizontal portion 136 may be integral with the vertical portion 132, or may be affixed thereto using conventional techniques, such as, for example, welding, brazing, and other like techniques. Similarly, the horizontal portion 136 may be integral with the guide track supporting feature 130 or may be coupled with or affixed thereto using conventional techniques, including those identified above. Among other things, the horizontal portion 136 is configured to provide space between the support structure 116 and the guide track 126 of the guide track system 112. It will be appreciated that in an embodiment wherein the mounting feature 128 does not include a horizontal portion, such as horizontal portion 136, the guide track supporting feature 130 would be integral with or coupled/affixed to another portion of the mounting feature 128, such as, for example and without limitation, the vertical portion 132 thereof.

As briefly described above, and with continued reference to FIGS. 5-8, the guide track supporting feature 130 is configured to join pieces 124 of the guide track 126 together. In such an embodiment, the bracket assembly 122 is thus configured to integrate the mounting of the guide track and the joining of guide track pieces together into a single apparatus. With reference to FIGS. 6 and 7, in an exemplary embodiment the guide track supporting feature 130 comprises a body 142 that, in an exemplary embodiment, takes the form of a plate (plate 158) and is connected to the mounting feature 128 (e.g., at the distal end 140 of the horizontal portion 136 thereof, for example). The plate 158, which, in an exemplary embodiment, has a rectangular shape, comprises a first end 144, a second end 146, a longitudinal axis 148 extending through the first and second ends 144, 146, a front side 160, and a back side 162. In the illustrated embodiment, the mounting feature 128 is connected to the plate 158 at one or more points along the back side 162 of the plate 158. In an exemplary embodiment, the body 142 of the guide track supporting feature 130 further comprises a plurality of protrusions 164 extending radially from the plate 158 relative to the longitudinal axis 148. The protrusions 164 may be integral with the plate 158, or alternatively, may be coupled thereto by, for example and without limitation, welding or brazing the protrusions 164 to the plate 158. In an exemplary embodiment, the protrusions 164 extend from the back side 162 of the plate 158 in a direction towards the mounting feature 128, and the vertical portion 132 thereof, in particular, such that the protrusions are parallel to, and in an exemplary embodiment coplanar with, the horizontal member 136.

Figure 5:
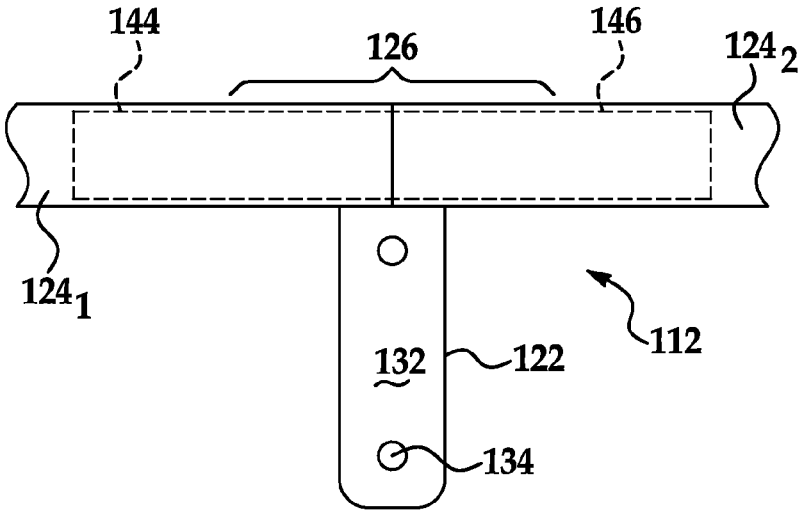
FIG. 5 is a partial front view of another exemplary embodiment of a guide track system for use in the track mounted ladder system illustrated in FIG. 1.
Figure 6:
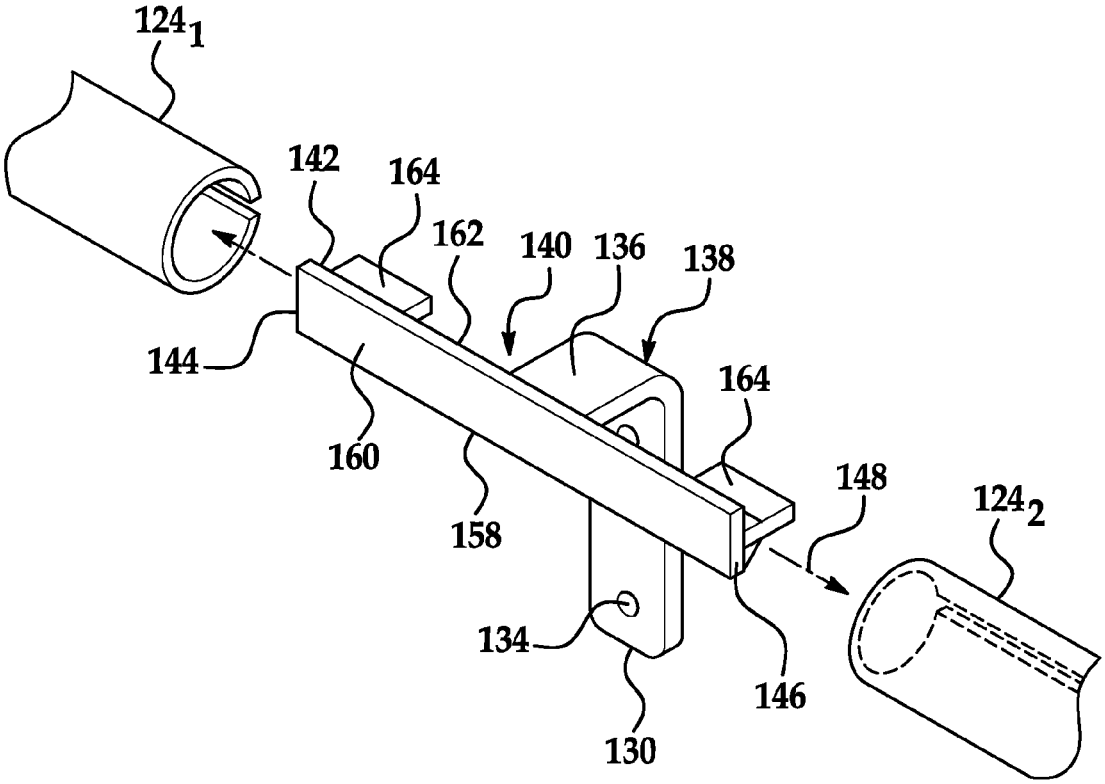
FIG. 6 is an exploded isometric view of the guide track system partially illustrated in FIG. 5.
Figure 7:
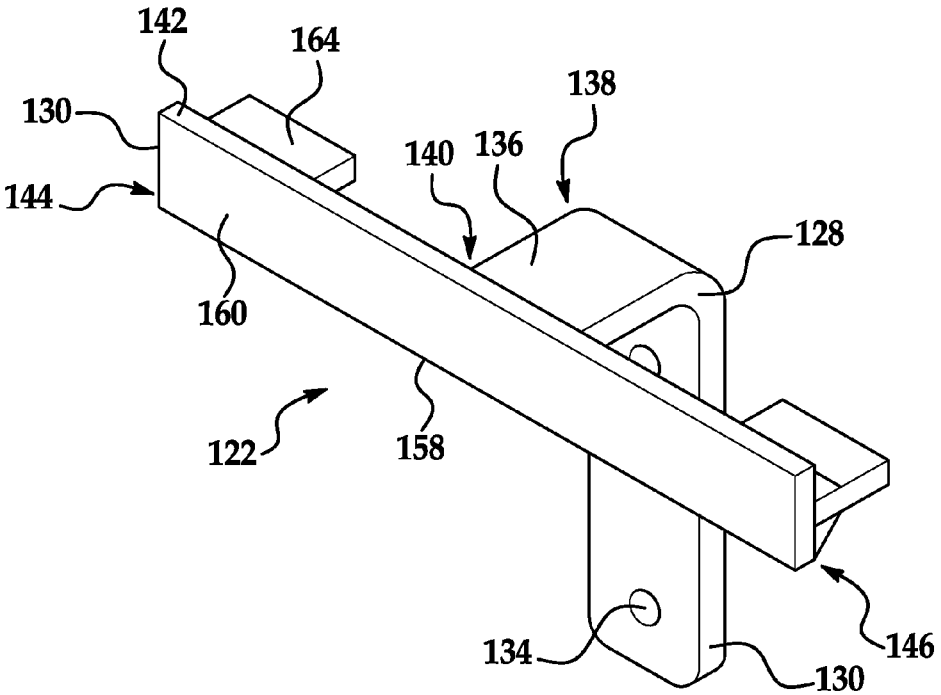
FIG. 7 is an isometric view of an exemplary embodiment of a bracket assembly of the guide track system illustrated in FIGS. 5 and 6.
Figure 8:
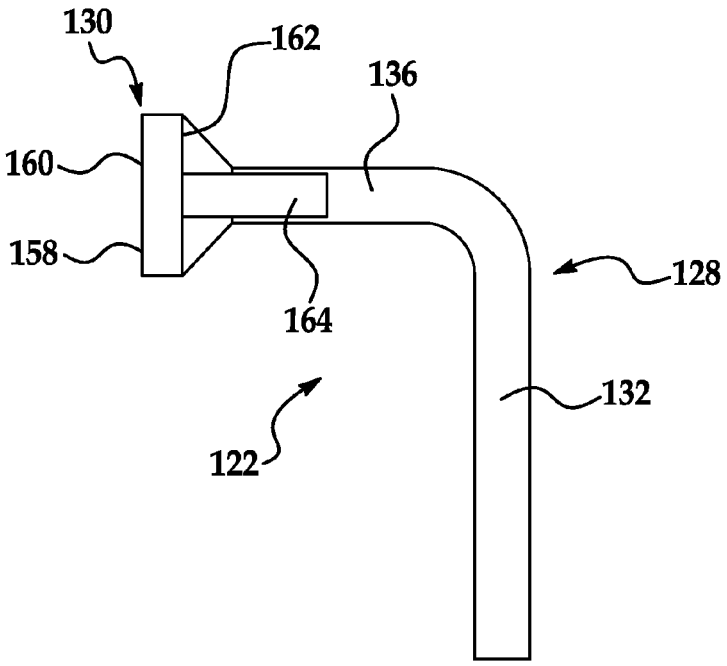
FIG. 8 is a side view of the bracket assembly illustrated in FIG. 7.

With reference to FIGS. 5 and 6, the first and second ends 144, 146 of the body 142 or plate 158 serve the purpose of a dowel such that the first end 144 and, in an exemplary embodiment, one or more of the protrusions 164, are configured to be coupled with and to engage an end of one open seam guide track piece 124 (e.g., guide track piece $\mathbf{124}_1$), while the second end 146 and, in an exemplary embodiment, one or more of the protrusions 164 are configured to be coupled with and to engage an end of another open seam guide track piece 124 (e.g., guide track piece $\mathbf{124}_2$). Accordingly, the guide track supporting feature 130 is configured, among other things, to join two guide track pieces 124 together to create a portion of the guide track 126. In an exemplary embodiment, the other ends of the guide track pieces $\mathbf{124}_1$, $\mathbf{124}_2$ are coupled with ends 144, 146 of adjacent bracket assemblies 122 such that each guide track piece 124 is coupled with, and disposed between, two bracket assemblies 122.

As with the guide track pieces 24 in the embodiment described above and illustrated in FIGS. 2-4, the guide track pieces 124 may be coupled with the guide track supporting feature 130 in a number of ways. In an exemplary embodiment, the ends of the respective guide track pieces $\mathbf{124}_1$, $\mathbf{124}_2$ may be slid onto the ends 144, 146 of the guide track supporting feature 130. More particularly, the guide track pieces $\mathbf{124}_1$, $\mathbf{124}_2$ may be aligned with the ends 144, 146 of the plate 158, and slid in a horizontal and axial direction (with respect to the axis 148) over the ends 144, 146 of the plate 158. Once the guide track pieces 124 are coupled with the guide track supporting feature 130, portions of the plate 158 contact or are engaged with the inner surface of the guide track pieces $\mathbf{124}_1$, $\mathbf{124}_2$. In an exemplary embodiment wherein the body 142 of the guide track supporting feature 130 also includes the protrusions 164 and the guide track pieces 124 comprise open-seam guide track pieces, the open seams of the guide track pieces $\mathbf{124}_1$, $\mathbf{124}_2$ may be aligned with the protrusions 164, and the guide track pieces $\mathbf{124}_1$, $\mathbf{124}_2$ may be slid in a horizontal and axial direction (with respect to the axis 148) over the ends 144, 146 and protrusions 164 of the guide track supporting feature 130. In such an embodiment, the edges of the open seams of the guide track pieces $\mathbf{124}_1$, $\mathbf{124}_2$ may be configured to contact and engage one or more of the protrusions 164 so as to hold the guide track pieces 124 in place. When assembled with the guide track supporting feature 130, and the body 142 or plate 158 thereof, in particular, the guide track pieces $\mathbf{124}_1$, $\mathbf{124}_2$ may be located such that the ends thereof make contact with each other to ensure a smooth and continuous bearing surface for the wheels of the ladder assembly 114 to travel across.

The bracket assembly 122, and the constituent components thereof, in particular, may be formed using one or more techniques/processes, and constructed of any number of materials. For example, the bracket assembly 122 may be formed using molding, casting, forging, welding, extrusion, or other like and/or known techniques or processes. Further, the entire assembly 122 may be formed of a metallic material (e.g., steel or stainless steel) or a polymeric material. Alternatively, the bracket assembly 122 may be formed of a combination of metallic and polymeric materials such that certain portions of the bracket assembly 122 may be formed of metal, while other portions may be formed of a polymeric material. Accordingly, the construction of the bracket assembly 122 is not limited to any one particular type of material, but rather may be formed of different types of materials and combinations of materials, each of which remain within the spirit and scope of the present disclosure.

Although only certain embodiments have been described above with a certain degree of particularity, those skilled in the art could make numerous alterations to the disclosed embodiments without departing from the scope of this disclosure. Additionally, any and all directional references (e.g., front, back, top, bottom, up, down, left, right) are only used for identification purposes to aid the reader's understanding of the present invention, and do not create limitations, particularly as to the position, orientation, or use of the invention. Joinder references (e.g., attached, affixed, coupled, connected, and the like) are to be construed broadly and may include intermediate members between a connection of elements and relative movement between elements. As such, joinder references do not necessarily infer that two elements are directly connected/coupled and in fixed relation to each other. It is intended that all matter contained in the above description or shown in the accompanying drawings shall be interpreted as illustrative only and not limiting. Changes in detail or structure may be made without departing from the invention as defined in the appended claims.

The invention claimed is:

1. A bracket assembly for supporting a guide track, comprising:

a mounting feature for mounting to a support structure, said mounting feature having a horizontal portion; and a guide track supporting feature connected to said horizontal portion of said mounting feature, wherein said guide track supporting feature comprises a body having a first end, a second end, and a longitudinal axis extending through said first and second ends, and further wherein said first end has a first size and a first shape that allows insertion into an opening of an end of a first piece of said guide track to couple and support said first piece of said guide track to said guide track supporting feature, and said second end has a second size and a second shape that allows insertion into an opening of an end of a second piece of said guide track to couple and support said second piece of said guide track to said guide track supporting feature, and wherein a center portion of said body extends radially outwardly relative to said longitudinal axis to a greater extent than said first end of said body and said second end of said body such that said center portion of said body is substantially flush with outer surfaces of the first and second pieces of said guide track, said center portion of said body further having opposing, engagement surfaces to engage wheels of a rolling ladder carriage, said horizontal portion of said mounting feature being connected to said body at a first side thereof that is intermediate said opposing, engagement surfaces.

2. The bracket assembly of claim 1 wherein said mounting feature is integral with said guide track supporting feature.

3. The bracket assembly of claim 1 wherein said mounting feature is coupled with said guide track supporting feature.

4. The bracket assembly of claim 3, wherein said body of said guide track supporting feature comprises an opening therein configured to receive the horizontal portion of said mounting feature.

5. The bracket assembly of claim 1, wherein said body of said guide track supporting feature comprises said first and second ends wherein said center portion is disposed therebetween.

6. The bracket assembly of claim 1, wherein one of said first and second ends of said body of said guide track supporting feature has a bore therein configured to receive said end of said respective first and second pieces of said guide track.

7. The bracket assembly of claim 1 wherein said body of said guide track supporting feature comprises a plate and a plurality of protrusions extending radially from said plate relative to said longitudinal axis.

8. The bracket assembly of claim 7, wherein said plate is configured to contact an inner surface of said first and second pieces of said guide track when said first and second pieces of said guide track are coupled with said first and second ends of said plate.

9. The bracket assembly of claim 7 wherein said guide track supporting feature is configured to support an open seam guide track, and an edges of the open seams of said first and second pieces of said guide track are configured to engage said protrusions extending from said plate.

10. A bracket assembly for supporting a guide track, comprising:

a mounting feature having a vertical portion for mounting to a support structure and a horizontal portion having a proximal end and a distal end, said horizontal portion connected at said proximal end to said vertical portion to form an L-shaped mounting feature; and a guide track supporting feature connected to said distal end of said horizontal portion of said mounting feature, wherein said guide track supporting feature comprises a body having a first end, a second end, and a longitudinal axis extending through said first and second ends, and further wherein said first end of said body has a first size and a first shape that allows insertion into an opening of an end of a first piece of said guide track to couple and support said first piece of said guide track to said guide track supporting feature, and said second end of said body has a second size and a second shape that allows insertion into an opening of an end of a second piece of said guide track to couple and support said second piece of said guide track to said guide track supporting feature, and wherein a center portion of said body extends radially outwardly relative to said longitudinal axis to a greater extent than said first end of said body and said second end of said body such that said center portion of said body is substantially flush with outer surfaces of the first and second pieces of said guide track, said center portion of said body further having opposing, engagement surfaces to engage wheels of a rolling ladder carriage, said horizontal portion of said mounting feature being connected to said body at a first side thereof intermediate said opposing, engagement surfaces.

11. The bracket assembly of claim 10, wherein said guide track supporting feature is integral with said horizontal portion of said mounting feature.

12. The bracket assembly of claim 10, wherein said guide track supporting feature is coupled with said horizontal portion of said mounting feature.

13. The bracket assembly of claim 12, wherein said body of said guide track supporting feature comprises an opening therein configured to receive said distal end of said horizontal portion.

14. The bracket assembly of claim 10, wherein said guide track supporting feature comprises said first and second ends wherein said center portion is disposed therebetween.

15. The bracket assembly of claim 10 wherein said body of said guide track supporting feature comprises a plate and a plurality of protrusions extending radially from said plate relative to said longitudinal axis of said body of said guide track supporting feature.

16. A guide track system, comprising:

a first guide track piece;

a second guide track piece; and a bracket assembly configured to support said first and second guide track pieces, said bracket assembly comprising:

a mounting feature for mounting to a support structure, said mounting feature having a horizontal portion; and a guide track supporting feature connected to said horizontal portion of said mounting feature, wherein said guide track supporting feature comprises a body having a first end, a second end, and a longitudinal axis extending through said first and second ends, said first end having a first size and a first shape that allows insertion into an opening of an end of said first guide track piece to couple and support said first guide track piece to said guide track supporting feature, and said second end having a second size and a second shape that allows insertion into an opening of an end of said second guide track piece to couple and support said second guide track piece to said guide track supporting feature, and wherein a center portion of said body extends radially outwardly relative to said longitudinal axis to a greater extent than said first end of said body and said second end of said body such that said center portion of said body is substantially flush with outer surfaces of the first and second guide track pieces, said center portion of said body further having opposing, engagement surfaces to engage wheels of a rolling ladder carriage, said horizontal portion of said mounting feature being connected to said body at a first side thereof intermediate said opposing, engagement surfaces.

17. The system of claim 16, wherein said mounting feature comprises a vertical portion configured to be mounted to said support structure, and said horizontal portion connected at a proximal end to said vertical portion and at a distal end to said guide track supporting feature.

18. The system of claim 16, wherein said body of said guide track supporting feature comprises said first and second ends wherein said center portion is disposed therebetween.

19. The system of claim 16 wherein said body of said guide track supporting feature comprises a plate and a plurality of protrusions extending radially from said plate relative to said longitudinal axis of said body of said guide track supporting feature.

* * * * *